US007063313B2

(12) United States Patent
Leu et al.

(10) Patent No.: US 7,063,313 B2
(45) Date of Patent: Jun. 20, 2006

(54) DEVICE FOR HOLDING PRINTED PRODUCTS

(75) Inventors: Willy Leu, Pfaffikon (CH); Erwin Muller, Durnten (CH)

(73) Assignee: Ferag AG, Hinwil (CH)

( * ) Notice: Subject to any disclaimer, the term of this patent is extended or adjusted under 35 U.S.C. 154(b) by 61 days.

(21) Appl. No.: 10/466,729

(22) PCT Filed: Oct. 24, 2001

(86) PCT No.: PCT/CH01/00632

§ 371 (c)(1),
(2), (4) Date: Jul. 16, 2003

(87) PCT Pub. No.: WO02/057167

PCT Pub. Date: Jul. 25, 2002

(65) Prior Publication Data

US 2004/0046306 A1 Mar. 11, 2004

(30) Foreign Application Priority Data

Jan. 19, 2001 (CH) ..... 0083/01

(51) Int. Cl.
*B65H 39/02* (2006.01)

(52) U.S. Cl. ..... 270/52.27; 270/52.23; 270/52.25

(58) Field of Classification Search ..... 270/52.23, 270/52.25, 52.27, 52.14, 52.19
See application file for complete search history.

(56) References Cited

U.S. PATENT DOCUMENTS

| | | | | |
|---|---|---|---|---|
| 5,094,438 | A | 3/1992 | Reist et al. | 270/55 |
| 5,104,108 | A | 4/1992 | Honegger | 270/55 |
| 5,248,135 | A * | 9/1993 | Leu | 270/52.27 |
| 5,462,266 | A * | 10/1995 | Meier | 270/52.16 |
| 5,474,286 | A * | 12/1995 | Reist | 270/52.25 |
| 5,758,871 | A * | 6/1998 | Schlough | 270/52.27 |
| 5,765,823 | A * | 6/1998 | Meier et al. | 270/58.23 |
| 5,810,345 | A | 9/1998 | Lehmann et al. | 270/52.26 |
| 6,691,966 | B1 * | 2/2004 | Schwarz et al. | 248/276.1 |

OTHER PUBLICATIONS

International Search Report Corresponding to International Application No. PCT/CH01/00632 From European Patent Office Dated Feb. 21, 2002.

* cited by examiner

*Primary Examiner*—Patrick Mackey
(74) *Attorney, Agent, or Firm*—Brinks Hofer Gilson & Lione

(57) ABSTRACT

A device for holding printed products fed in variations of at least collecting and collating feed modes. The device includes a holding element for holding products fed in different feed modes. The holding element, in turn, includes a deflection element which, in a printed product transfer region, is effective to deflect printed products being fed away from those already fed to the holding element.

14 Claims, 8 Drawing Sheets

Fig.5
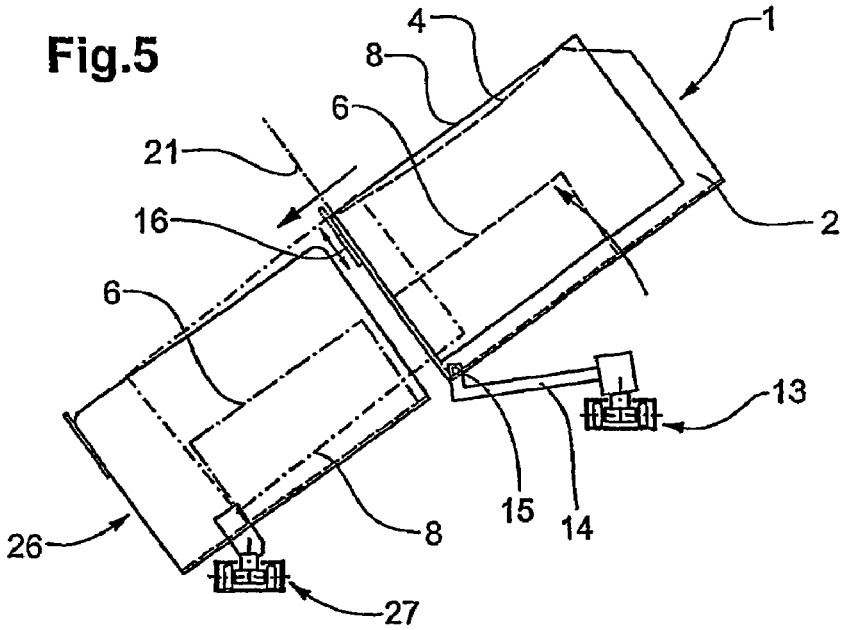
Fig.6
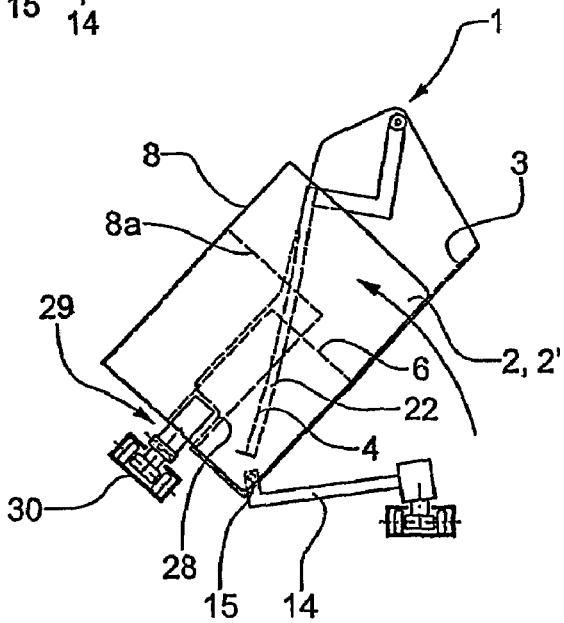
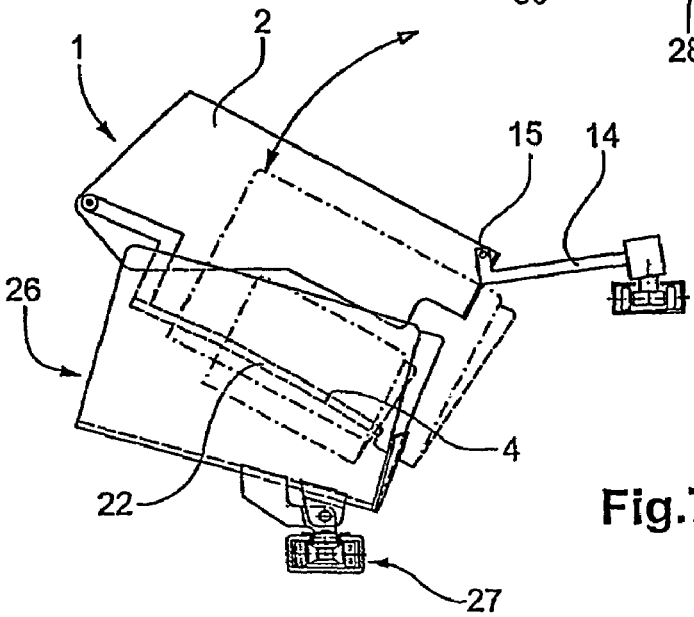
Fig.7

DEVICE FOR HOLDING PRINTED PRODUCTS

RELATED APPLICATIONS

This application is a nationalization of PCT Application No. PCT/CH01/00632 filed Oct. 24, 2001. This application claims priority from Swiss Patent Application No. 2001-0083/01 filed on Jan. 19, 2001.

The invention relates to a device for holding printed products as claimed in claim 1.

In order to produce a printed end product from a plurality of individual printed products, it is known to place a plurality of centrally folded printed products astride a saddle-like support. This production mode will be designated collecting or the collecting mode below. Furthermore, it is known to introduce a plurality of folded or unfolded printed products into pocket-like holding elements in such a way that they come to lie beside one another. This will be designated collating below. Finally, it is also known to insert one or more folded or unfolded printed products into a folded and opened printed product, which will be designated insertion below. In order to produce a complex printed end product, for example a newspaper or a periodical, it is desirable to insert, collate and/or to collect individual printed products in any desired order as required. In order to insert printed products into one another, for example WO 98/33656 discloses a method in which folded printed products are inserted into one another or into a folded main product in a defined way. In this case, the main product is located in a pocket-like holding element. EP-A 0771754 discloses a device for bringing printed products together, in which printed products are held by pocket-like holding elements or holding elements with an L-shaped cross section. The holding elements have a flat supporting element which is inclined slightly out of the vertical, and a base element angled away therefrom, which the printed products strike with one of their edges. An upper part of the supporting element, extending horizontally, forms a support, on which printed products can be placed astride. This upper part and the interface between base and supporting elements define a feed plane in which printed products are fed. For the purpose of combined collation and collection, the lower part of the supporting element, adjoining the base element, is designed to be pivotable about the boundary line between base and supporting elements. Since, during the pivoting action, held products can be moved out of the feed plane, it is possible with this supporting element firstly to collate a number of products and then to collect a number of products. However, it is not possible, following the collection, to bring more than one further printed product to a previously defined point by means of collection or collation. This is because a second further printed product would strike a first further printed product edge to edge when fed in and would then randomly slip either to the right or to the left beside the first further printed product or even fall out of the holding element.

Furthermore, in the case of collecting and collating printed products using known holding elements, there is the difficulty that printed products of different format can at most be aligned along a common side edge. The two edges of the collected or collated products, running at right angles to the side edge, are defined by the position of the base element and the support. The removal of a completely assembled printed end product in such a way that all the part products are gripped is therefore made more difficult, in particular when part products of very different formats are used.

The invention is therefore based on the object of providing a device for holding printed products which, without adjustment work on the holding element itself, can be used for producing printed end products with multifarious possible variations. In particular, it should be possible to achieve high flexibility with regard to the formats of the printed products used and/or to the order of the printed products fed in, at least in the "collecting" and "collating" feed modes.

The object is achieved by a device having the features of claim 1. Advantageous developments are illustrated in the dependent claims, the description and the drawings.

The deflection element which is present according to the invention and which is assigned to a holding element for printed products, at least in a transfer region, is able to deflect a printed product fed to the holding element away from the printed products already held. The printed product fed in is therefore positioned in a defined way. The printed product is preferably deflected away, in the "collating" feed mode, in such a way that at least part of the printed product fed in is positioned on the side facing away from the supporting element and belonging to printed products already held. In the "collecting" feed mode, part of the folded and opened printed product is brought into position beside a product already deposited, while the other part is arranged on the other side of the supporting element.

Holding element and deflection element are configured in such a way that, at least in a transfer region, in which individual printed products are transferred to a holding element, they are moved at the same speed and in the same direction of movement, in the following designated the output conveying speed and direction. In this case, the holding elements are preferably moved past various feed stations, at which in each case individual printed products are output to the holding elements. The deflection elements can be arranged in the region of these feed stations and only there moved together with the holding elements. Alternatively, each holding element can be assigned its own deflection element, which is continually moved together with the latter, preferably by being fixed to the latter.

The deflection element can preferably additionally be moved in a direction at right angles to the conveying direction of the holding elements, so that following the deposition of a printed product deposited on the support, it can if necessary be pulled forward under the latter. In this way, a further printed product that is subsequently deposited is again exposed to the deflecting action of the deflection element. For this purpose, the deflection element can preferably be moved parallel to the support or pivoted about an axis extending substantially in the conveying direction. Another variant provides for the deflection element to extend over only part of the width of the holding element and for deposited printed products to be pushed downward by the latter if they do not lie astride the deflection element. This can be done by means of a slide or by pivoting the holding element about an axis extending substantially in the conveying direction, so that the printed products are moved to that end of the holding element which faces away from the deflection element. For this purpose, the holding element preferably has a stop at this end, which is located in the region of the support and/or the base part or the supporting element.

As a result of the combination according to the invention of the holding element with a deflection element, printed end products with any desired arrangement of their individual constituents can advantageously be implemented. The invention can be integrated in a straightforward manner into one of the known devices for bringing flat products together, for example as disclosed in EP-A 0771754. The printed products can be fed to the holding elements in a known way, for example as described in EP-A 0771754 or in the Swiss patent application number 2000 0414/00, not previously published, and its cognate, U.S. 2003-0146563-A1 or in CH 689864. In order to open folded printed products before collecting, for example, use can be made of a gripper transporter according to Swiss patent applications numbers 2000 0416/00 and 2000 0417/00, not previously published and the cognate U.S. Pat. No. 6,823,757 and No. 6,726,000, respectively.

According to a further embodiment of the invention, the support is configured such that it can be pivoted downward. As a result of the support being pivoted downward, the printed products fed in collecting mode are placed on the base element largely independently of their format. Collected and collated printed products are therefore aligned automatically along the base plane and preferably also along a common side edge. The removal of the printed end product by simultaneously gripping the part products is therefore particularly simply possible, without having to adapt a transfer device to different formats. In this case, the deflection element can also be dispensed with.

Exemplary embodiments of the invention are illustrated in the drawing, in which, purely schematically:

FIGS. 1*a*, 1*b* show a holding element according to the invention with a deflection element that can be moved independently thereof in two different views;

FIGS. 2*a*, 2*b* show a holding element according to the invention with a deflection element arranged fixedly thereon;

FIGS. 3*a*, 3*b* show a holding element according to the invention with a deflection element that is fixed thereon and can be moved at right angles to the conveying direction;

FIGS. 4*a*, 4*b* show a further holding element according to the invention with a deflection element that is fixed thereon and can be displaced linearly, and a pivotable support;

FIG. 5 shows the transfer operation on a holding element into a further holding element by pushing printed products over;

FIG. 6 shows the transfer operation resulting from gripping printed products with a gripper;

FIG. 7 shows the transfer operation into a further holding element by pivoting the first holding element over;

Figure 8A:
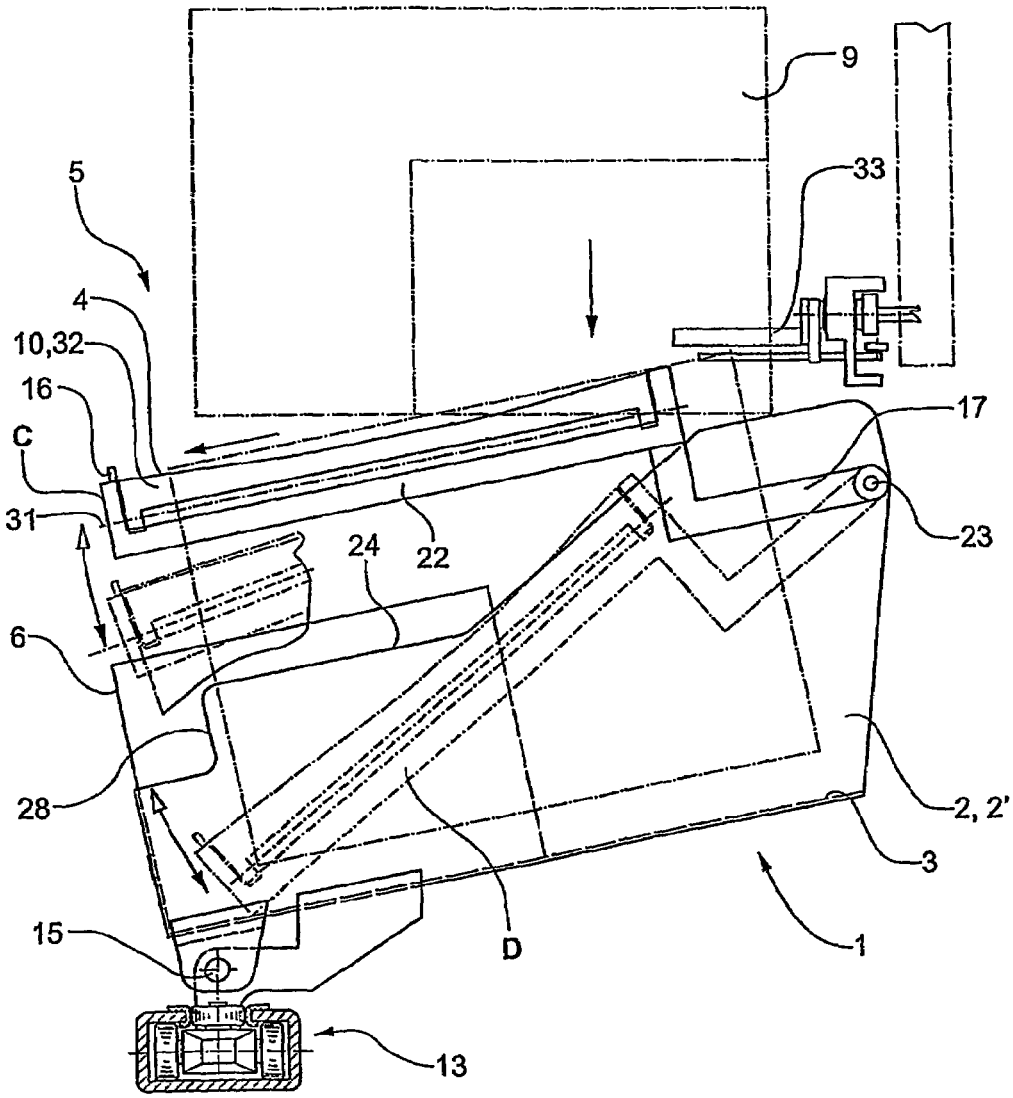
Figures 8B, 8C, 8D:
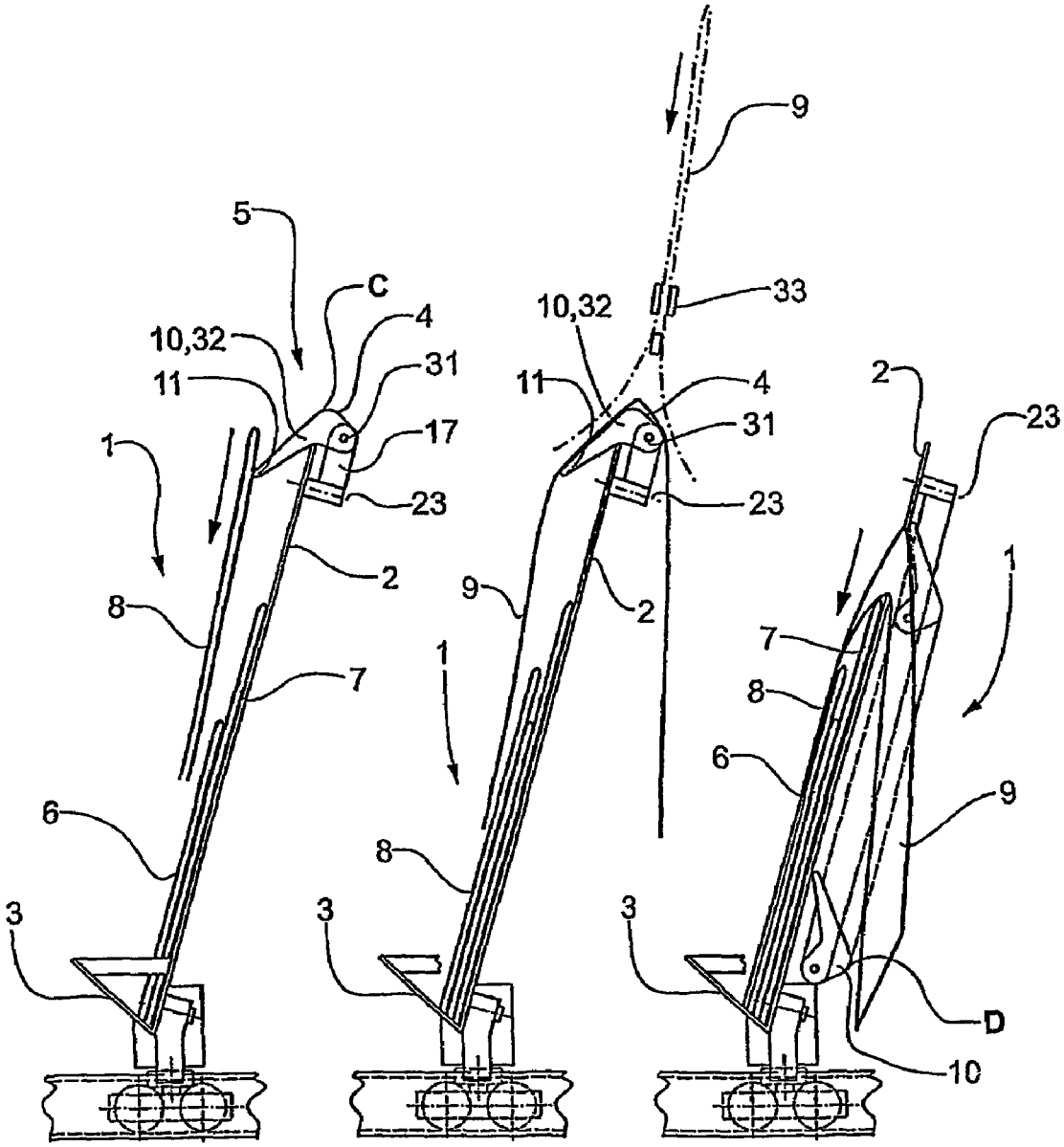
Figure 9:
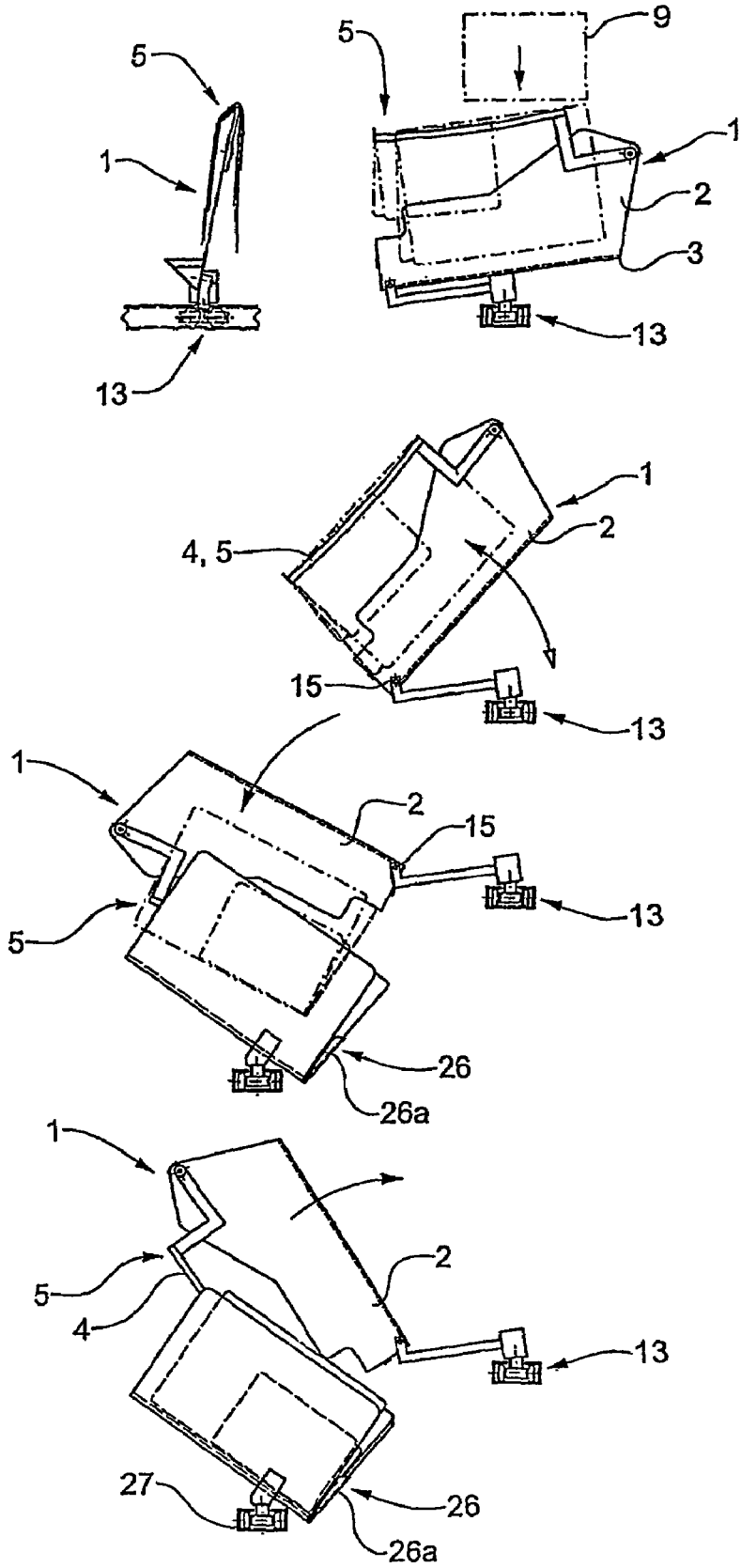

FIGS. 8*a*–8*d* show a further holding element according to the invention having a pivotable deflection element which is used simultaneously as a support;

FIG. 9 shows the course of the transfer of an assembled printed end product to a further holding element with a holding element according to FIGS. 8*a–d;*

Figure 10:
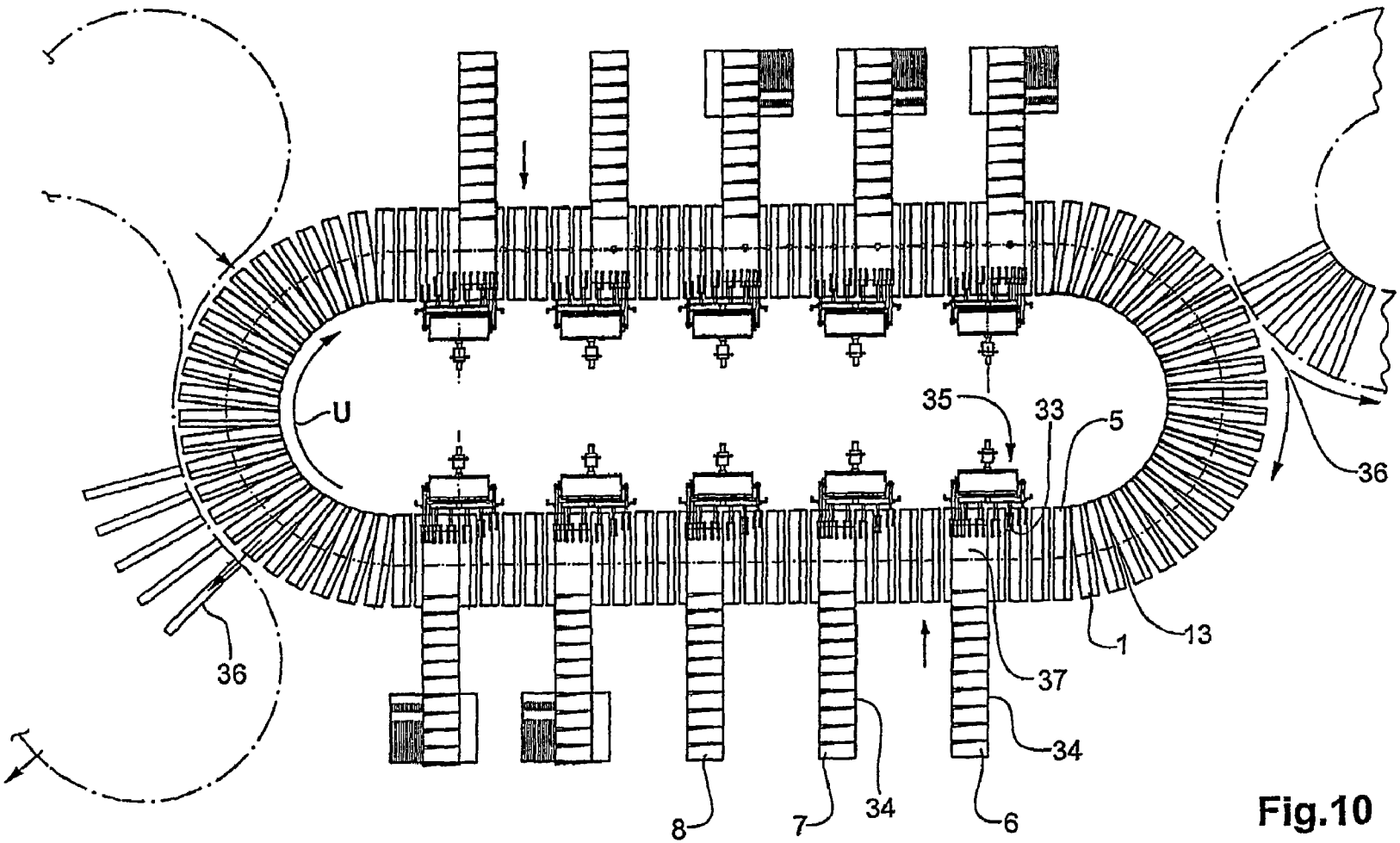
Figure 11A:
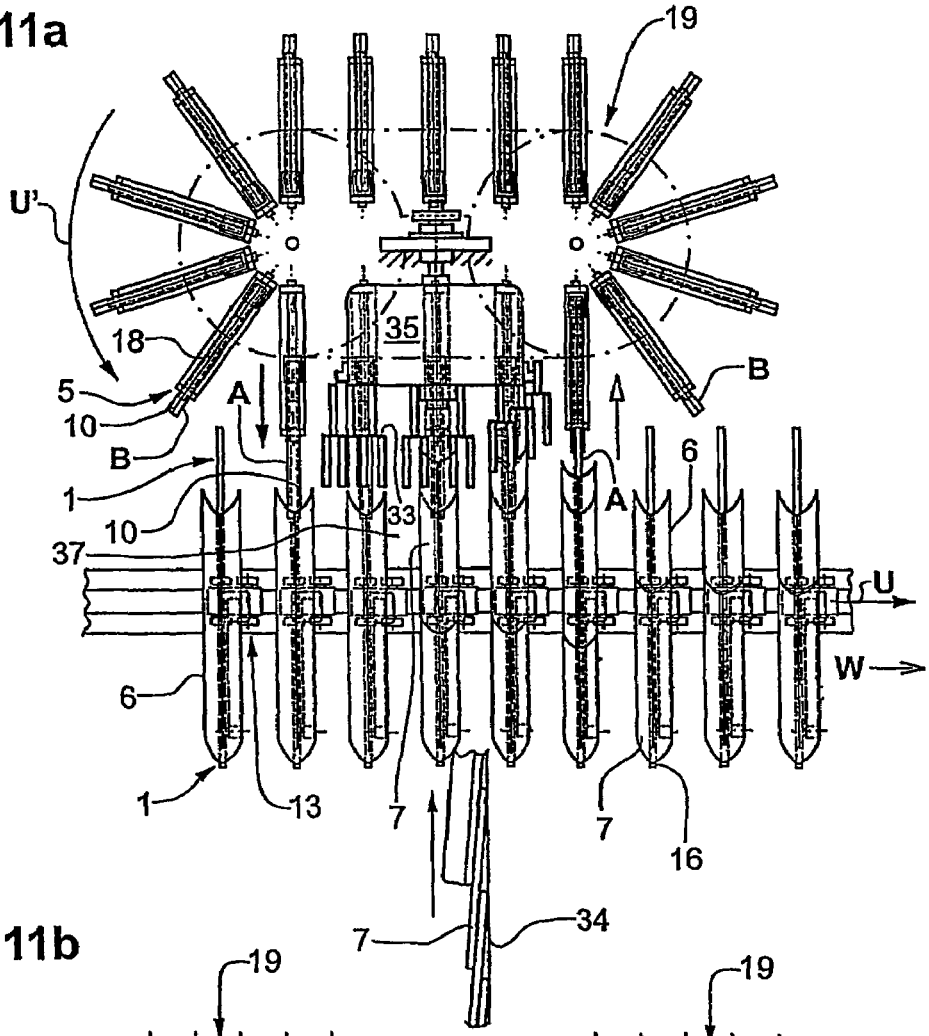

FIG. 10 shows a device for leading individual printed products together to form a printed end product with a plurality of holding elements;

FIGS. 11*a*/11*b* show a partial view of the device according to FIG. 10 in the region of one and two feeds, respectively.

Figure 1B:
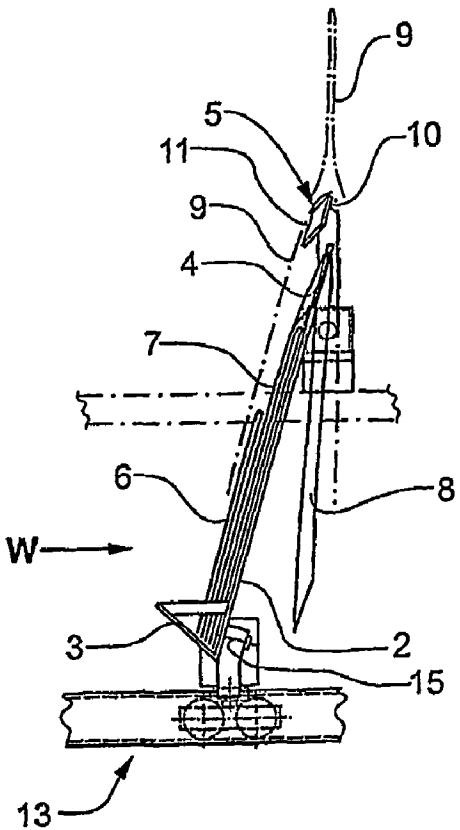
Figure 1A:
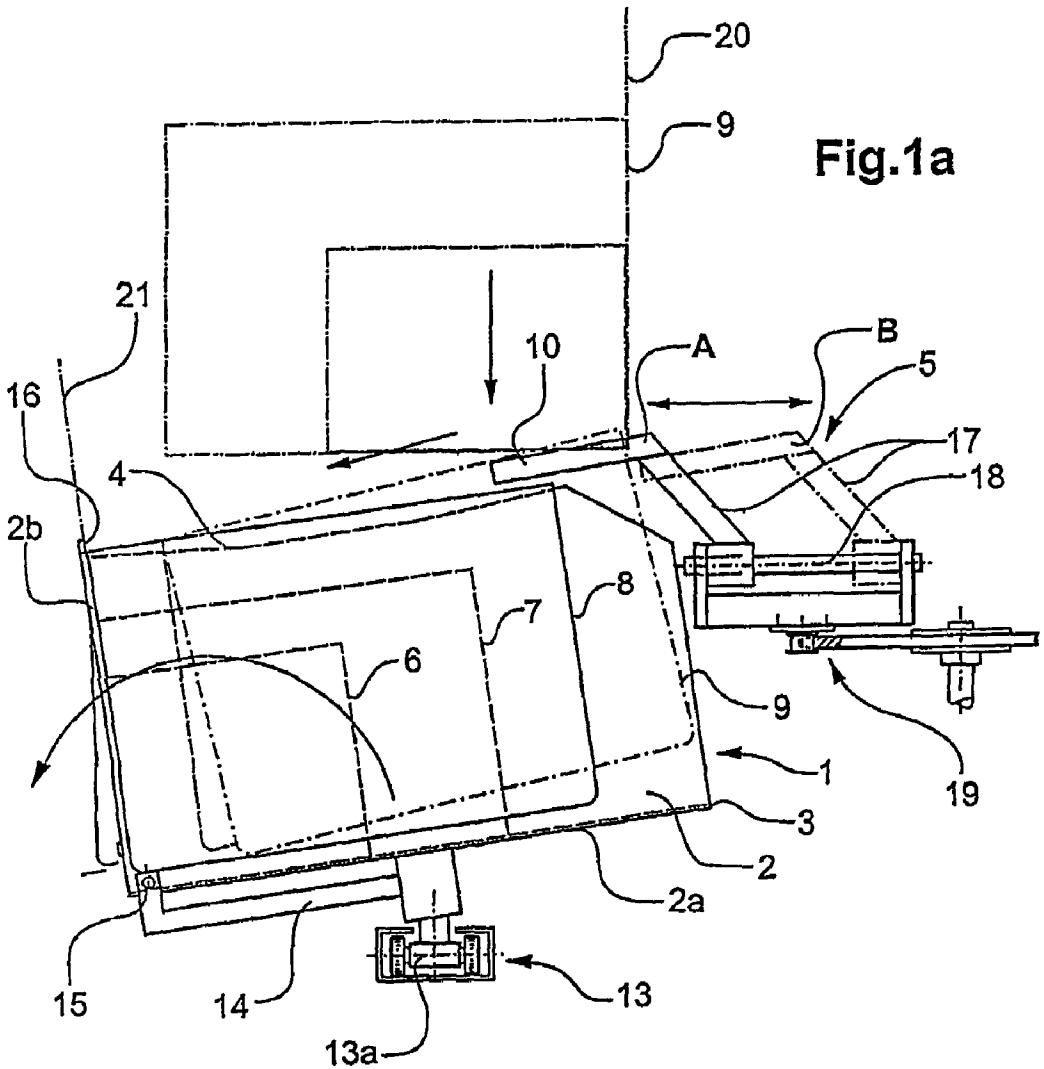

FIGS. 1*a* and 1*b* show a holding element 1 according to the invention and a deflection element 5 according to the invention in two different views in the conveying direction W and at right angles thereto. The holding element 1 comprises a flat supporting element 2 and a base element 3 projecting at an angle therefrom at the lower end. The supporting element 2 is inclined slightly from the vertical, so that base element 3 and supporting element 2 form a pocket-like holder or support surface for flat products. The upper edge of the supporting element 2 forms a support 4, on which folded printed products 8 can be placed astride. Using the holding element 1, printed products can therefore be both collated, like the printed products 6 and 7 here, and also collected, like the printed products 8 here and the newly added printed product 9. The order and the number of the products fed in in a specific mode can be chosen freely. The lower edge 2*a* of the supporting element 2 is inclined slightly from the horizontal, so that collated and collected printed products slip as far as the outer edge 2*b* of the supporting element 2, facing away from the deflection element 5. For collected products, at the end of the support 4 that faces away from the deflection element 5 there is a stop 16, which can also be movable relative to the supporting element 2. All the printed products are therefore aligned along a common edge 21, irrespective of the format. They can be gripped at this edge 21 to be transported away or for further processing.

The holding element 1 can be moved in the conveying direction W by a conveying system 13. The holding elements 1 are, for example, moved along a closed circulation path U, as illustrated in FIG. 10. The supporting element 2 is connected via an outrigger 14 to a conveying means 13*a* in the form of a carriage, and can be pivoted about an axis 15 extending substantially in the conveying direction. In this case, the ability to be pivoted is primarily used for emptying the holding element 1, as illustrated for example in FIGS. 7 and 9. The holding element 1 can, however, also be pivoted about the axis 15, in order to align all the held printed products with the common edge 21. This is advantageous in particular for the variant of a holding element shown in FIG. 2 with a deflection element 5 fixed permanently thereto.

The deflection element 5 comprises a web 10 which, as the actual deflector, deflects printed products 9 newly fed in away from printed products 6, 7, 8 which have already been deposited, so that the printed product 9 newly fed in is positioned at the side of the latter. The printed products 9 fed in are aligned along a common edge 20, this edge 20 being located above the deflection element 5 during the feeding process. Therefore, all the printed products 9, irrespective of their format, are subjected to the action of the deflection element 5 at the same point. A longitudinal edge of the web 10 in this case acts as a deflection surface or edge 11, over which incoming products 9 slide and which defines a feed plane. The deflection surface 11 is spaced apart from the contact plane defined by the supporting element 2. The distance preferably corresponds to the thickness of the parts of a typical printed end product that are held by the base element 3 and supporting element 2. In principle, the deflection element is configured in such a way that at least parts thereof are spaced apart from the contact plane defined by the supporting element 2. These parts define the feed plane, which lies outside the contact plane.

In the example of FIG. 1, printed products 9 are fed from above and slide over the web 10 of the deflection element 5. If the printed products are fed in in the "collating" mode, then because of the oblique position of the supporting element 2, they largely slide themselves into their end position, in which they terminate flush with the common edge 21. In the "collecting" mode, the printed products initially come to lie on the web 10. In the example of FIG. 1, the latter is moved from a first position A, in which it performs a deflector function, into a second position B. As a result, web 10 is pulled forward under the fold, so that the printed product 9 is deposited on the support 4. In order to move between the positions A and B, the deflection element 5 is fixed to a linear rail 18 such that it can move. The web 10 is connected via a holding arm 17 to the rail 18 and can slide on the latter. In the process, the web 10 moves substantially parallel to the direction defined by the support 4. The deflection elements 5 are moved together with the holding elements 1 by a conveying system 19, as shown for example in FIGS. 11*a* and 11*b*.

Figure 2A:
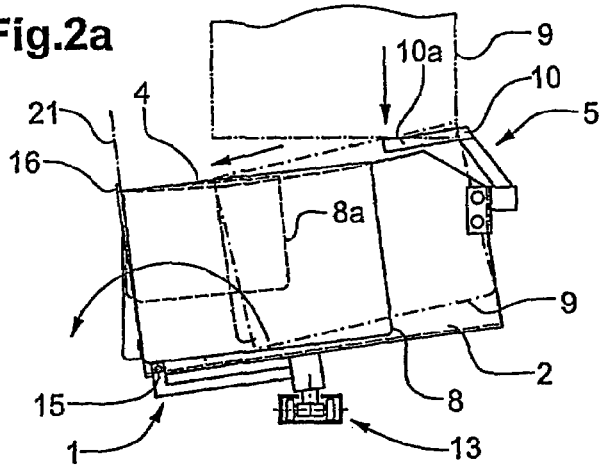
Figure 2B:
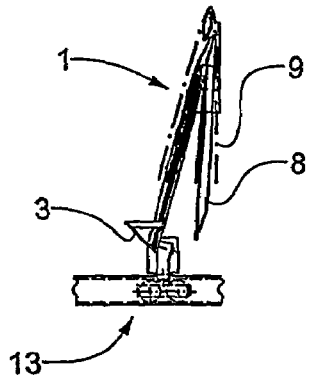

FIGS. 2*a* and 2*b* show a further embodiment of a holding element 1 according to the invention, having a supporting element 2 and a base element 3 and also having a deflection element 5 according to the invention. In this case, the deflection element 5 is fixed firmly to the supporting element 2. Printed products 9 slide over the deflection element 5 and, during collecting, initially come to lie to some extent on the web 10 of the deflection element 5. Because of the inclination of the supporting element 2 from the horizontal, the printed products 9 fed in slide as far as the end of the support 4 which faces away from the deflection element 5. There, they are stopped by a stop 16. The distance of the stop 16 from the tip 10*a* of the web 10 in this case corresponds at least to the typical maximum edge length of a printed product. Printed products 8*a*, 8, 9 held by the holding element 1 are aligned along the vertical edge of the holding element 1 that faces away from the deflection element 5, so that a common edge 21 is formed irrespective of the format. In the present example with a deflection element 5 fixed firmly to the supporting element 2, the supporting element 2 itself is wider than the embodiment according to FIGS. 1*a, b*. The construction of the deflection element 5 is simpler as compared with the movable embodiment according to FIGS. 1*a, b*.

Figure 3A:
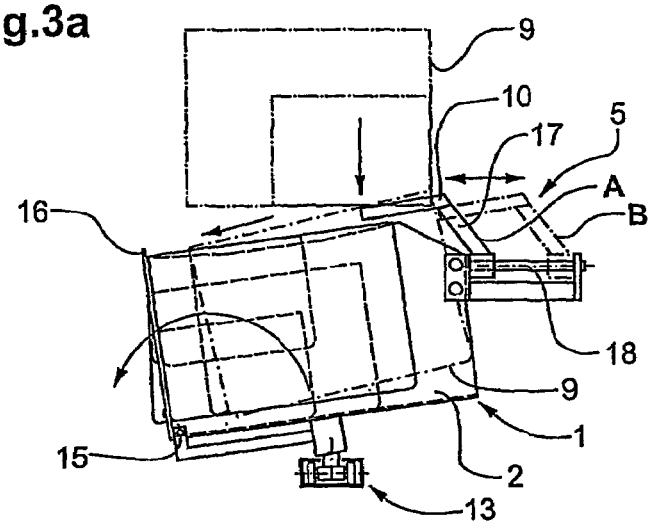
Figure 3B:
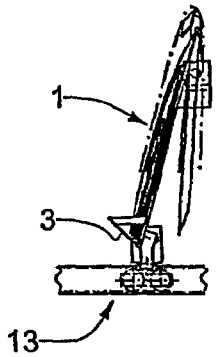

FIGS. 3*a, b* show a further embodiment of a holding element 1 according to the invention, having a supporting element 2 and a base element 3 and also a deflection element 5 which is fixed to the supporting element 2 and can be displaced linearly relative thereto. The construction of the holding element 1 and of the deflection element 5 corresponds substantially to FIGS. 1*a, b*. The deflection element, having a web 10 and a holding arm 17, can be displaced along a rail 18 between a first position A and a second position B. As opposed to FIGS. 1*a, b*, no dedicated conveying system for deflection elements is provided, instead the deflection element 5 is fixedly connected to the corresponding holding element. The ability to be displaced between the positions A and B is preferably implemented by web 10 and holding arm 17 being able to be held in the second position B by means of a spring and being able to be moved into the first position A by means of a slotted guide.

Figure 4A:
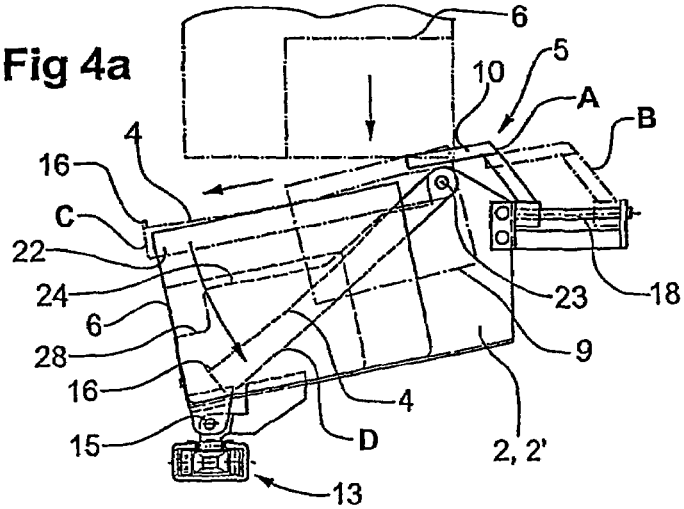
Figure 4B:
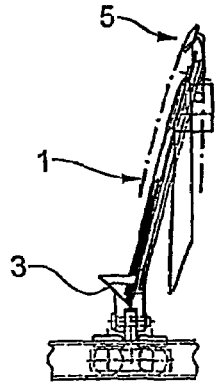

FIGS. 4*a, b* show a further example of a holding element 1 according to the invention with a deflection element 5. As in the example of FIGS. 3*a, b*, the deflection element 5 is fixed to the supporting element 2 of the holding element and in this case can be moved along a rail 18 between a first position A and a second position B. In the present case, the supporting element 2 is designed in two parts, the support 4 being formed by the upper edge of an arm 22 that is connected to the basic body 2' of the supporting element 2 such that it can be pivoted. The arm 22 can be pivoted from a substantially horizontal position C, about an axis 23 running substantially at right angles to the surface defined by the supporting element 2, into a further position D. Therefore, in the "collecting" mode, printed products 9 fed in are initially deposited astride the arm 22 or astride the support 4. As a result of the arm 22 being pivoted into the position D, they are placed on the base element 5 irrespective of their format and are aligned along the base edge. The assembled printed end product can then be gripped for removal. In order to permit gripping with a gripper even in the case of smaller formats, the basic body 2' of the supporting element 2 has an indentation 28 approximately at the central level, into which a gripper can engage, as illustrated for example in FIG. 6. The basic body 2' further has an edge 24 which extends substantially horizontally and which supports the printed products even when the arm 22 is pivoted down.

FIG. 5 shows a possible way of transferring printed products 6, 8 held in a holding element 1 to a further holding element 26. For this purpose, the holding element 1 is pivoted about an axis 15 running substantially in the conveying direction W. The stop 16 arranged in the region of the support 4 is moved in such a way that products 8 collected on the support 4 can slide into or onto the further holding element 26. Products 6 collated in the first holding element 1 likewise slide into the further holding element 26. Collected products 8 are transferred in such a way that they are located completely on or within the second holding element 26. The further holding element 26 can be moved by a further conveying system 27.

Holding element 1 is then available for the renewed holding of printed products. Using the conveying system 13, it is transported into transfer regions, in which, as already described, deflection elements are moved together with the holding element 1 in order to deflect products.

FIG. 6 shows a further possible transfer of printed products 8, 8*a*, 6 held in a holding element 1 by using a gripper 29. In this case, the supporting element 2 is equipped with a pivotable support 4 as described in principle in conjunction with FIGS. 4*a, b*. In the present case, the deflection element 5 is not fixed firmly to the supporting element 2 but is merely moved synchronously together with the latter in the transfer region in order to feed products. In order to remove the products 8, 8*a*, 6 held in the holding element 1, the arm 22, whose upper edge forms the support 4, is pivoted toward the base element 3 of the holding element. At the same time, the supporting element is pivoted out of the horizontal, about the axis 15. By engaging in an indentation 28 in the basic body 2' of the supporting element 2, all the printed products can be gripped at once in a defined position in relation to each other by the gripper 29 and transported away by a gripper transport system 30.

FIG. 7 shows a further possible transfer of printed products held in the holding element 1 to a further pocket-like holding element 26. In this case, the supporting element 2 of the holding element 1 is pivoted through about 120 degrees about the axis 15, as a result of which the products held by it are conveyed headfirst into the holding pocket of the further holding element 26. The arrangement and order of the printed products is maintained in this case, however. The oblique position of the further holding element means that the printed products are again aligned along a common edge.

FIGS. 8*a–d* show a further example of a holding element 1 according to the invention, having a two-part supporting element 2 which comprises a pivotable arm 22 and a basic body 2'. The arm 22 has a support 4 and a stop 16. It can be pivoted toward the base element 3 about an axis 23 running at right angles to the basic body 2'. In the present embodiment, the arm 22 also serves as a deflection element 5. For this purpose, it has a movable flap 32 which extends over a large part of its overall length. The upper edge of the flap 32 forms the support 4. The flap 32 has the same function as the web 10 from FIGS. 1–4. Its front longitudinal edge 11 is spaced apart from the basic body 2' of the supporting element 2 when the arm 22 is in the upper position C. The longitudinal edge 11 therefore functions as a deflection surface. In order to be able to pivot the arm 22 into the lower position D, as shown in FIG. 8*d*, the flap 32 can be pivoted about a pivot axis 31 running parallel to the support 4. The flap 32 and the web 10 in the state C therefore serve to hold further printed products 8 away from the printed products 6, 7 already collated (FIG. 8*b*) or printed products 9 fed in in the collecting mode away from the printed products 6, 7, 8 already deposited (FIG. 8*c*). When the arm 22 is pivoted down into the position D, products 9 deposited in the collecting mode are placed over already collated products 6, 7, 8 and placed on the base element 3. The action of pivoting the arm 22 into an intermediate position, as shown here, can be used as a product alignment function during collecting. As already described in connection with FIGS. 4*a, b*, the basic body 2' has an indentation 28, in which a gripper can engage in order to remove the printed products. Using a further gripper 33, printed products are fed in from above in such a way that they are deflected away by the deflection element 5 and, in the process, slide into the holding element 1.

FIG. 9 shows a possible way of transferring printed products from a holding element 1 according to FIGS. 8*a–d* into a further pocket-like holding element 26. As already shown in FIG. 7, the supporting element 2 is pivoted by about 120 degrees out of the horizontal about an axis 15, so that the printed products, which either lie on the support 4 formed by the deflection element 5 or, standing on the base element 3, are inclined against the supporting element 2, fall headfirst into the pocket 26. The pocket 26 is inclined out of the horizontal and, and at its end pointing downward, has a stop 26*a*, by means of which the printed products are aligned along a common edge. The further holding element 26 is transported by means of a further conveying system 27.

FIG. 10 shows a plan view of a device for producing, for example, printed end products with a combination according to the invention of holding elements 1 and deflection elements 5. The holding elements 1 are moved along a closed circulation path U, for which purpose use is made of a conveying system 13, not specifically illustrated here. Individual printed products 6, 7, 8 are fed to the holding elements 1 at individual feed stations. In the present case, printed products are transported in an overlapping formation by means of a feeding device 34 into a transfer region 37 above the movement path of the holding elements 1. They are gripped there by individual grippers 33, opened if necessary and transferred from above to the holding elements 1. For this purpose, use is made of a transport device 35 which, for example, is described in the Swiss patent application no. 2000 0414/00, not previously published, and cognate U.S. 2003-0146563-A1. At further corresponding stations, further printed products 7, 8 are fed in. In this case, the holding elements 1, after passing a number of stations, can be emptied again in an emptying station 36. Arranged along the further circulation path are further feed stations, in which the holding elements 1 are populated again. By means of a single device, therefore, two different series of printed end products can be produced. Alternatively, in the present example all ten feed stations can be used for the production of a single printed end product from ten individual printed products. In this case, one of the two removal stations 36 arranged between the five feed stations in each case is not used. The system shown permits great flexibility with respect to the assembly of the printed end products.

Figure 11B:
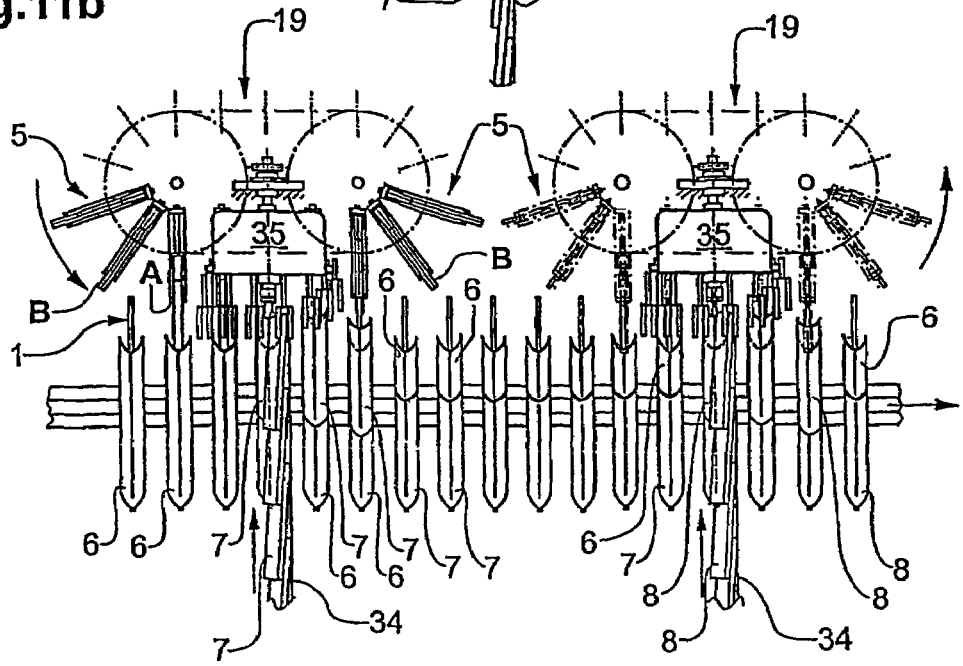

FIGS. 11*a*, 11*b* show a partial view of a device for producing printed end products. FIG. 11*a* shows a device having a feed station, FIG. 11*b* with two feed stations arranged one after the other, of which one can also be deactivated or removed (shown dashed). Holding elements 1 are transported along a closed circulation path U in the conveying direction W by a conveying system 13. They are in each case already given a printed product 6 fed in in collecting mode. In the transfer region for further printed products 7, deflection elements 5 according to the invention are moved synchronously with the holding elements 1. The deflection elements 5 are in this case moved by means of a further conveying system 19, likewise along a closed circulation path U', which runs parallel to the circulation path U in the transfer region 37. The deflection elements 5 can be moved linearly between a position B and a position A along a rail 18, a web 10 of the deflection element projecting in the manner of a roof over the holding element 1 in the position A. Printed products 7 fed along a feed 34 in overlapping formation are gripped by a gripper transporter 35 having a circulation space 33 running around in a vertical plane, are opened and placed from above on the holding elements 1 moved past. In this case, the printed products 7 initially slide onto the web 10 of the deflection element 5. Because the latter, when it leaves the transfer region, is pulled back into the position B again, the printed products 7 slide onto the printed product 6 already deposited on the support. As a result of the oblique position of the holding element 1, they slide onto that end of the holding element facing away from the deflection element 5, to the stop 16 arranged there. In a further processing station, further printed products 8 are fed in in the same way in the collecting mode.

What is claimed is:

1. In a conveying system, a device for holding printed products in a transfer region, comprising:

at least one holding element, said one holding element including a supporting element, a base element and a support, the supporting element and the base element being constructed and arranged to hold printed products from the side or from below, the support being constructed and arranged to hold folded printed products astride; and a deflection element movable relative to said holding element between at least two positions, said deflection element having a deflection surface spaced apart from said holding element and effective, when in at least one of said two positions, to deflect a printed product fed to the holding element so that it is held positioned either completely on that side of printed products already held which, standing on the base element, face away from the supporting element, or part of the printed product placed astride the support is positioned on that side of printed products already held which face away from the supporting element.

2. The device as claimed in claim 1, wherein each holding element, at least in the transfer region, is assigned a deflection element which, at least in the transfer region, is moved substantially at the same conveying speed and in the same conveying direction (W) as the holding element.

3. The device as claimed in claim 1, wherein said deflection surface runs at least approximately parallel to the support and which is spaced apart from a contact plane defined by the supporting element.

4. The device as claimed in claim 1, wherein the holding element has a stop, by which at least printed products resting astride the support are stopped during a movement in the direction of the support.

5. The device as claimed in claim 4, wherein the distance between the stop and that end of the deflection element which faces the stop is at least as great as the maximum length of a printed product measured in the same direction.

6. The device as claimed in claim 1, wherein the deflection element can be moved relative to the holding element, at least between a first position (A), in which it is able to deflect printed products, and a second position (B), in which it is not able to deflect printed products.

7. The device as claimed in claim 6, wherein the deflection element can be displaced linearly between the first and the second positions (A, B) in a direction running substantially parallel to the support.

8. The device as claimed in claim 1, wherein the deflection element or the support can be pivoted or displaced about an axis running substantially at right angles to the supporting element.

9. The device as claimed in claim 1, wherein the deflection element has a holding arm and a flap fixed thereto and having the deflection surface, the flap being pivotable relative to the holding arm in such a way that the deflection element can be lowered in the direction of the base element.

10. The device as claimed in claim 1, wherein the deflection element is connected to the holding element.

11. The device as claimed in claim 1, wherein the holding element can be pivoted about an axis running substantially at right angles to the supporting element in order to discharge held printed products.

12. A method of feeding printed products onto a holding element in a printed product transfer region comprising the steps of:

providing a holding element which has a supporting element, a base element and a support, the supporting element and the base element being constructed and arranged to hold printed products from the side or from below, the support being constructed and arranged to hold folded printed products astride;

serially feeding printed products in at least one of a collation mode and a collecting mode onto said holding element;

providing a deflection element movable relative to said holding element between at least two positions, said deflection element having a deflection surface spaced apart from said holding element; and before each printed product is deposited on said holding element, deflecting the printed product being deposited with said deflection surface when said deflection element is in one of said at least two positions so that the product is held positioned either completely on that side of printed products already held which, standing on the base element, face away from the supporting element, or part of the printed product placed astride the support is positioned on that side of printed products already held which face away from the supporting element.

13. The method of claim 12 wherein:

the supporting element and the base element receive and support printed products from the side or below.

14. The method of claim 13 wherein:

the support receives printed products astride.

* * * * *